US006640498B1

(12) United States Patent
Groeneveld

(10) Patent No.: US 6,640,498 B1
(45) **Date of Patent: *Nov. 4, 2003**

(54) DOOR STRUCTURE WITH DEFORMABLE PERIPHERAL EDGE

(75) Inventor: Dirk Hugo Groeneveld, Ridderkerk (NL)

(73) Assignee: Nederlandse Organisatie voor Toegepast-Natuurwetenschappelijk Onderzoek TNO (NL)

( * ) Notice: Subject to any disclaimer, the term of this patent is extended or adjusted under 35 U.S.C. 154(b) by 0 days.

This patent is subject to a terminal disclaimer.

(21) Appl. No.: 09/869,729

(22) PCT Filed: Jan. 4, 2000

(86) PCT No.: PCT/NL00/00003

§ 371 (c)(1),
(2), (4) Date: Oct. 17, 2001

(87) PCT Pub. No.: WO00/40828

PCT Pub. Date: Jul. 13, 2000

(30) Foreign Application Priority Data

Jan. 4, 1999 (NL) ..... 1010945

(51) Int. Cl.[7] ..... E05C 9/06
(52) U.S. Cl. ..... 49/395; 49/394
(58) Field of Search ..... 49/394, 395, 402, 49/503; 292/4, 32, 36, 304, 256.5, 257

(56) References Cited

U.S. PATENT DOCUMENTS

| | | | | |
|---|---|---|---|---|
| 2,511,268 A | * | 6/1950 | Schiff | 114/117 |
| 2,511,286 A | | 6/1950 | Millen | |
| 3,180,303 A | * | 4/1965 | Hamilton | 114/203 |
| 4,435,921 A | * | 3/1984 | Marin | 16/388 |
| 4,527,760 A | * | 7/1985 | Salacuse | 24/DIG. 53 |
| 4,971,369 A | * | 11/1990 | Jean | 292/36 |
| 5,086,587 A | | 2/1992 | Andrews | |
| 5,129,693 A | * | 7/1992 | Schmitt | 292/300 |
| 5,199,369 A | | 4/1993 | Meyer et al. | |
| 6,101,764 A | * | 8/2000 | Guy-Paul | 292/196 |
| 6,260,304 B1 | * | 7/2001 | Groeneveld | 292/4 |

FOREIGN PATENT DOCUMENTS

WO 9844228 10/1998

* cited by examiner

*Primary Examiner*—Gregory J. Strimbu
(74) *Attorney, Agent, or Firm*—Webb Ziesenheim Logsdon Orkin & Hanson, P.C.

(57) ABSTRACT

A door structure has a first plate with an opening enclosed by a peripheral edge and a door connected to this first plate by a hinge construction, which first plate carries a number of clamps which are simultaneously rotatable by an operating mechanism with an operating handle and through rotation can co-act with the peripheral surfaces of corresponding non-round continuous holes in the door. The peripheral surfaces each have a contact surface inclining relative to the main plane of the door structure, and the continuous holes have a form such that the clamps can pass therethrough. The peripheral edge is deformable under the influence of an air pressure pulse acting on the door structure in the closed position such that at least the door can be pressed out of the main plane it occupies when the door structure is in the closed position while maintaining the sealing co-action between the door and the peripheral edge, and the mechanical integrity of the door structure.

17 Claims, 9 Drawing Sheets

DOOR STRUCTURE WITH DEFORMABLE PERIPHERAL EDGE

BACKGROUND OF THE INVENTION

1. Field of the Invention

The invention relates to a door structure, comprising:

a first plate serving as fixed frame with an opening enclosed by a peripheral edge; and a door connected pivotally to this first plate by at least one hinge construction such that with its peripheral zone the door can co-act sealingly with said peripheral edge;

which first plate carries a number of peripherally arranged clamps, which clamps are simultaneously rotatable by a collective operating mechanism with an operating handle and through rotation can co-act with the peripheral surfaces of corresponding non-round continuous holes in the door, which peripheral surfaces have for each clamp a contact surface inclining relative to the main plane of the door structure in the closed situation, which continuous holes have a form such that a clamp can pass therethrough.

2. Description of the Prior Art

A known door structure, such as that disclosed in PCT Publication No. WO-A-98/44228, was embodied such that it met high standards of resistance to fire and explosion. To this end the known door structure was embodied in mechanically very strong and non-deformable manner, whereby the sealing and mechanical integrity of the door structure was preserved even under extreme conditions.

It is an object of the invention relative to this prior art to provide a door structure which meets the higher standards of fire and explosion resistance.

SUMMARY OF THE INVENTION

With a view hereto, the door structure according to the present invention has the feature that the door comprises a second plate which is received in a framework which co-acts sealingly with the peripheral edge in the closed position;

the clamps are arranged symmetrically pairwise on rotation shafts;

the continuous holes in the door are correspondingly formed slotted holes;

each peripheral surface of a continuous hole in the door has two substantially symmetrically located, inclining clamp contact surfaces; and the peripheral edge is deformable under the influence of an air pressure pulse acting on the door structure in the closed position such that at least the door can be pressed out of the main plane it occupies when at rest while maintaining the sealing co-action between the framework and the peripheral edge and the mechanical integrity of the door structure.

The advantage of the structure according to the invention lies in the fact that the use of mechanical strengthening as in the described prior art is dispensed with, whereby the door structure can be lighter and can be manufactured more cheaply.

A specific embodiment has the special feature that the peripheral edge comprises a plate part with a thickness substantially smaller than the thickness of the first plate. This smaller thickness has the result that the plate part, and therewith the peripheral edge, deforms relatively easily under the influence of an air pressure pulse which can occur for instance during an explosion.

The door construction can in particular have the special feature that the thickness of the plate part amounts to a maximum of 0.5 times the thickness of the first plate.

In accordance with yet another aspect of the invention, the door structure has the special feature that the second plate has a thickness substantially smaller than the thickness of the first plate such that the second plate is deformable in the manner of a membrane under the influence of said air pressure pulse.

This latter embodiment can be particularly characterized herein in that the thickness of the second plate amounts to a maximum of 0.3 times the thickness of the first plate.

The door structure preferably has the special feature that the peripheral edge comprises a plate part which has a substantially prismatic, general wave shape with at least one wave.

In order to prevent sharp transitions in the four corners, the embodiment is recommended in which the peripheral edge is angled in its four corners and thus takes the form of an octagon.

This latter variant is preferably embodied such that the angles of the octagon are (135±20)°.

In order to ensure the sealing and mechanical integrity of the door structure, also under very extreme deforming conditions, use can be made of hooking means present on respectively the peripheral edge and the door peripheral zone which only enter into hooking co-action when a certain minimal deformation of the door structure is exceeded as a result of an air pressure pulse acting thereon.

For the best possible symmetrical loading of the structure and the avoidance of mechanical stresses, the door structure can preferably be embodied such that the clamps and the associated holes are placed symmetrically.

A very good combination of low cost and high quality is realized with an embodiment in which the door structure consists substantially of metal, for instance steel.

The term "substantially" is understood to mean that the door structure may also comprise non-dominant components of a different composition. The door structure can for instance comprise thermal insulation material such as mineral wool. In addition, appropriate parts are generally provided with anticorrosive and protective coatings, while sealing means can for instance consist of rubber or rubber-like materials.

For the proper desired deformability under the said conditions, the door structure can be embodied such that the second plate consists of steel plate with a thickness of a maximum of 3 mm.

For the same reason the door structure can have the special feature that the plate part consists of steel plate with a thickness of a maximum of 5 mm.

A particular embodiment is characterized by a neoprene rubber sealing ring which seals the door relative to the first plate in closed situation.

A specific embodiment has the special feature that each clamp comprises a rotation shaft which is provided with screw thread and co-acts with a nut present on the peripheral edge such that a rotation of a clamp entails an axial displacement.

Depending on the orientation of the screw thread the axial displacement resulting from the action of the clamps can be enhanced or, conversely, prevented subject to the set requirements for the design. When the axial displacement is prevented by the clamps themselves, a greater clamping force can be realized, while in the other case a greater axial displacement is obtained.

A preferred embodiment has the special feature that each clamp is coupled via a transmission with a certain dead stroke to the collective operating mechanism. This structure prevents in all conditions possible spontaneous release of the clamps in the case where great bending occurs, which can be the case particularly in the case of explosive pressure loads. The described dead stroke in accordance with the above described final aspect of the invention prevents unintentional opening of the door in such conditions.

BRIEF DESCRIPTION OF THE DRAWINGS

The invention will now be elucidated with reference to the annexed drawings. In the drawings.

DETAILED DESCRIPTION OF THE INVENTION

Figure 1:
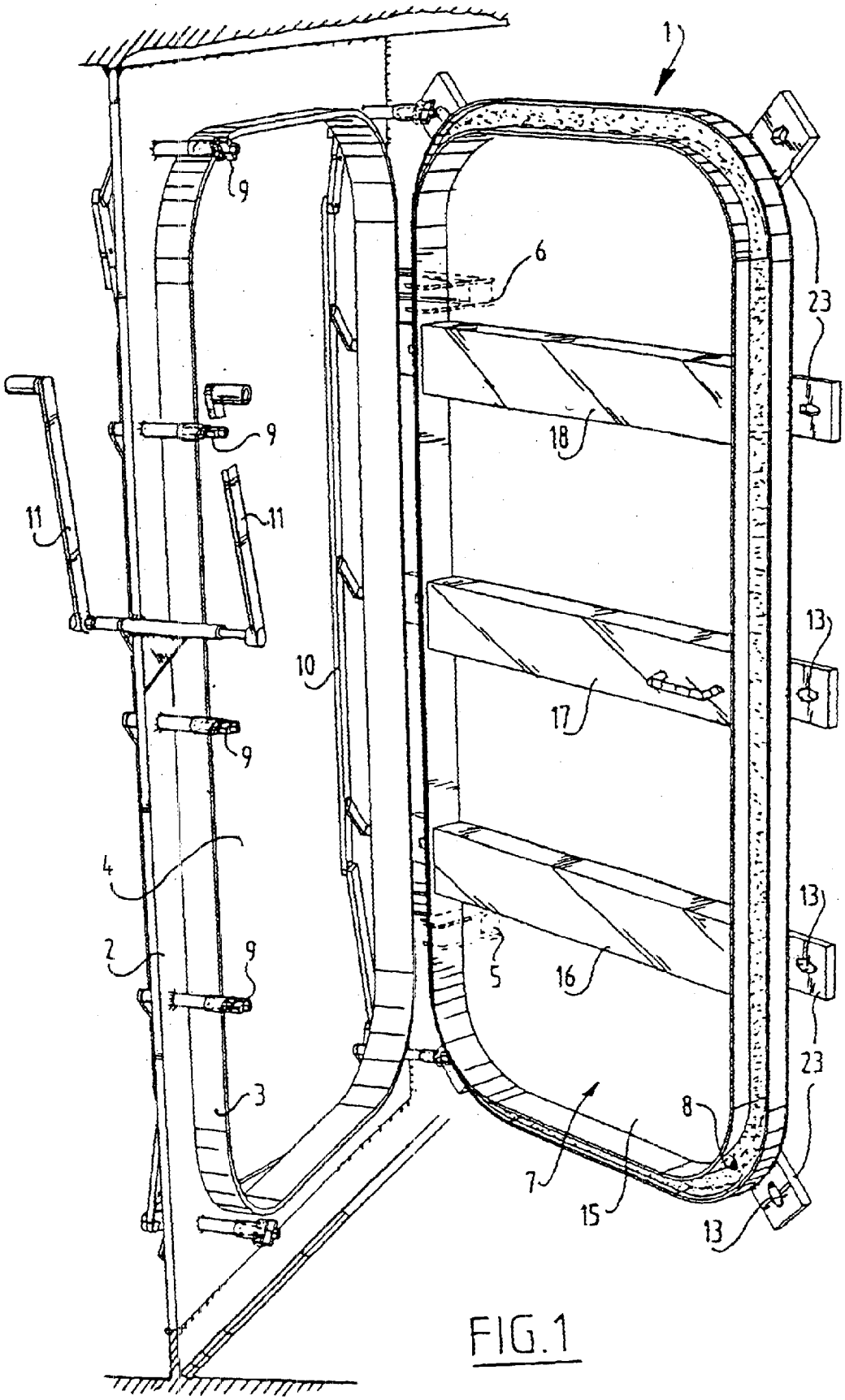
FIG. 1 shows a perspective view of a door structure according to WO-A-98/44228.

The figures show a door structure 1. This door structure 1 comprises a first plate 2 serving as fixed frame with an opening 4 enclosed by a peripheral edge 3 and a door 7 pivotally connected to this first plate 2 by at least one hinge construction 5, 6 such that with its peripheral zone 8 the door 7 can co-act sealingly with said peripheral edge 3, which first plate 2 carries in this embodiment ten peripherally arranged clamps 9, which clamps 9 are simultaneously rotatable by a collective operating mechanism 10 with an operating handle 11 and can co-act through rotation with peripheral zones 12 of corresponding non-round continuous holes 13 in door 7, which peripheral zones 12 have for each clamp 9 a contact surface 14 inclining relative to the main plane of door structure 1 in the closed situation, which continuous holes 13 have a form such that a clamp 9 can pass therethrough. Door 7 comprises a second plate 15 which is strengthened in this embodiment with three beams 16, 17, 18 which are welded to this plate 15 and which extend between two clamps situated on either side of the door. Clamps 9 are constructed such that they each consist of two sub-clamps, designated for instance 9*a* and 9*b* in FIG. 4, which are arranged symmetrically pairwise on a rotation shaft 16. The continuous holes 13 in the door are slotted holes, the form of which by and large corresponds with the form of clamps 9, and are so much larger that the clamps can pass through the holes. Each peripheral zone 12 of a continuous hole in door 7 has two substantially symmetrically located, inclining clamp contact surfaces 14*a*, 14*b*. It is noted that the angle at which the inclining clamp contact surfaces 14*a*, 14*b* extend can be freely chosen within certain limits. What is essential is that clamps 9*a*, 9*b* can be placed in wedging co-action with the inclining contact surfaces 14*a*, 14*b* in question. In this respect attention is drawn to the fact that various functional modifications are possible. The clamps themselves can for instance be provided with inclining surfaces co-acting with corresponding non-inclining elevations. By rotating the clamps the same operation is then obtained, i.e. by displacing handles 11 a rotation of the clamps takes place such that owing to the inclining contact surfaces a slight swinging of the door takes place relative to the fixed frame, whereby the desired clamping can be ensured. It is further noted that the clamps can be arranged on the door, in which case the continuous holes and the associated contact surfaces in the zones around the holes form part of the fixed frame.

Door 7 is generally elongate; the common axis of hinges 5, 6 extends in vertical longitudinal direction; strengthening beams 16, 17, 18 extend in horizontal transverse direction.

The second plate 15 is substantially flat and each beam has a U-shaped profile and is welded substantially wholly to this plate 15 with its free end edges 19.

FIGS. 3, 4, 5 and 6 show clearly that around the rotation shaft 16 of a clamp 9 is situated a filler piece 20 fitting into the corresponding hole in door 7. This filler piece can be of any suitable material. Filler piece 20 can for instance be manufactured from metal, but a suitable plastic can also be considered. In respect of the possible calamities for which the door structure according to the invention is designed, a plastic can be of a type which degenerates at high temperature and thereby acquires a hard and more or less foamed structure. This ensures the best possible gastight sealing. In this respect a metal plate 21 is also added to the filler piece. As the figures clearly show, this metal plate 21, which of course does not necessarily have to be present, improves the sealing of the closed door structure.

Figure 2:
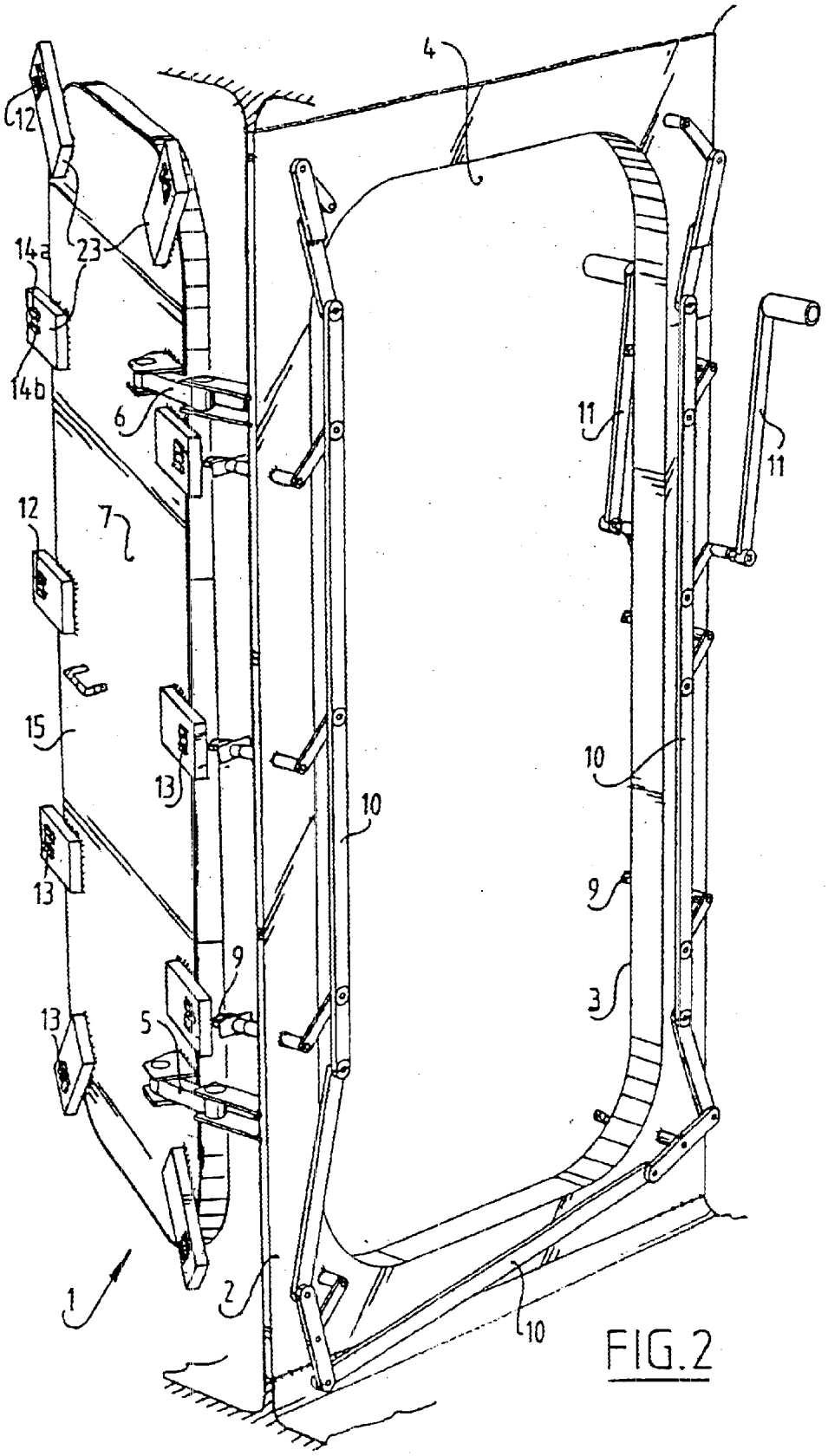
FIG. 2 shows a perspective view of the door structure according to FIG. 1 from the other side.

In usual structures continuous holes consist of two separate lips placed at a mutual distance. For the sake of optimum strength and integrity, also in the case of calamities, according to the invention each continuous hole 13 in door 7 is preferably wholly enclosed by material. As FIGS. 1 and 2 show clearly, clamps 9 and the associated continuous holes 13 are placed symmetrically relative to the axis of symmetry of the door structure.

The entire door structure 1 preferably consists substantially of metal, for instance steel.

The second plate 15 preferably consists of plate steel with a thickness of 3–10 mm, in particular about 5 mm.

Each beam 16, 17, 18 preferably has a wall thickness of 2–8 mm, in particular 4 mm, and preferably consists of steel with a high yield point, for instance QSTE 420 with a yield point of ≧350 kPa.

The peripheral zone 8 of the door has a sealing ring 21 preferably consisting of neoprene rubber which seals door 7 relative to peripheral edge 3 in the closed situation.

Figure 3:
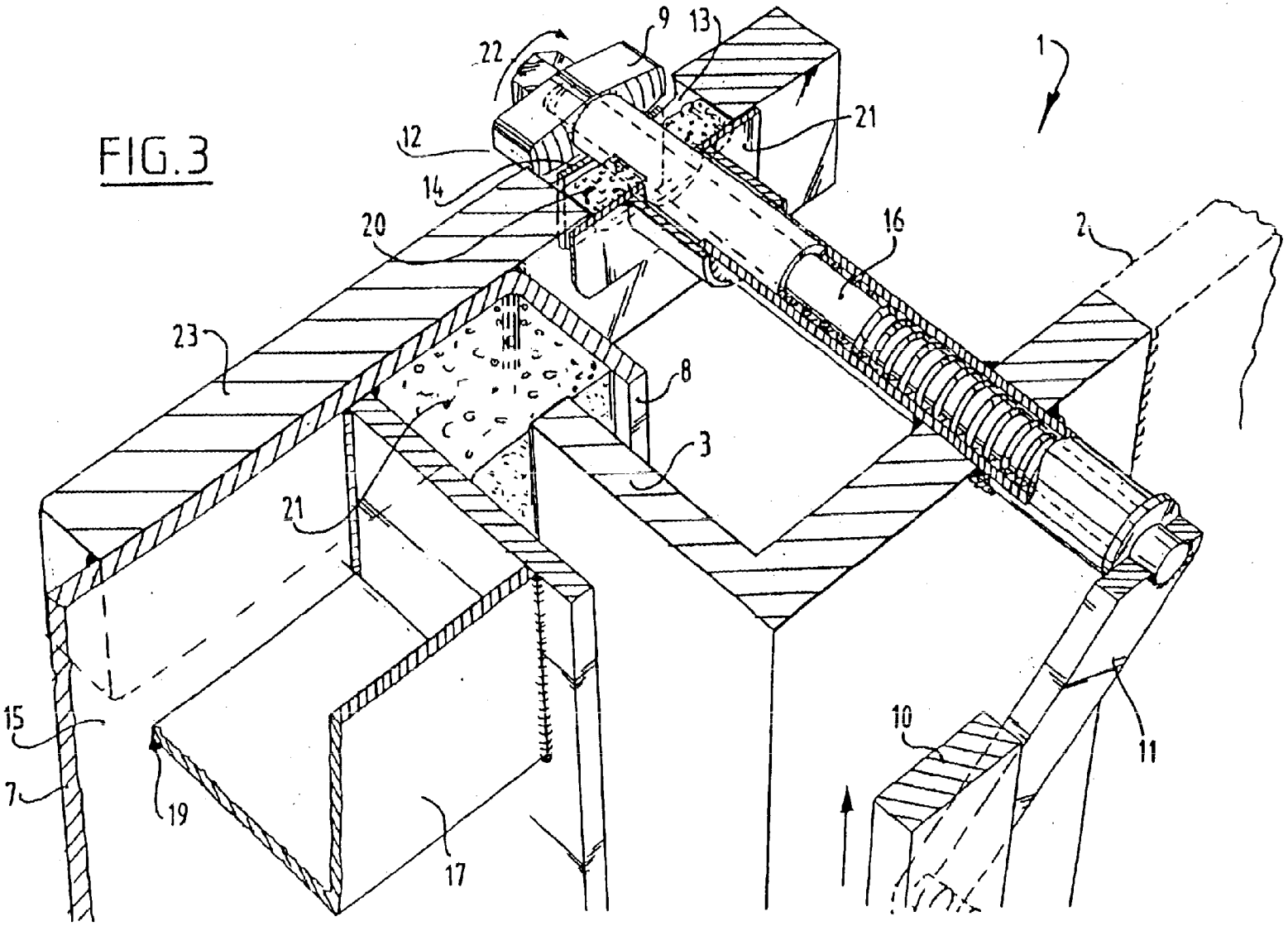
FIG. 3 shows on larger scale a partly broken-away perspective view of a clamp.

FIG. 3 clearly shows the manner in which peripheral edge 3 can co-act sealingly with neoprene rubber sealing ring 21.

In the situation shown in FIG. 3, door 7 is closed from the open position shown in FIGS. 1 and 2. Clamp 9 is passed through continuous hole 13. In this situation the door can still be freely opened. By rotating shaft 16 by operating an operating handle 11 a rotation according to arrow 22 takes place, whereby the more or less cylindrically formed contact surfaces 23*a* and 23*b* come into clamping contact with the respective contact surfaces 14*a* and 14*b*. The situation obtained hereby is shown in FIG. 5.

Figure 5:
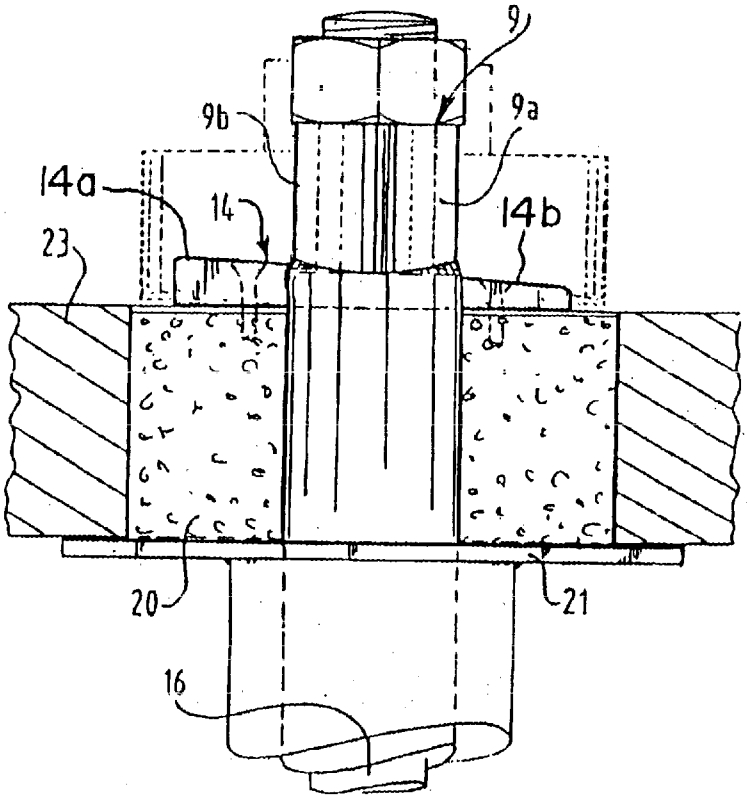
FIG. 5 is a longitudinal section through the clamp according to FIG. 4.

FIG. 5 shows in broken lines the free situation and in full lines the closed situation of the door structure.

Contact surfaces 14, 14*a*, 14*b* can form an integral part of the separate elements 23 which are welded to plate 7 and have the continuous holes 13, but can also be embodied as protrusions separately arranged on these elements 23.

Figure 4:
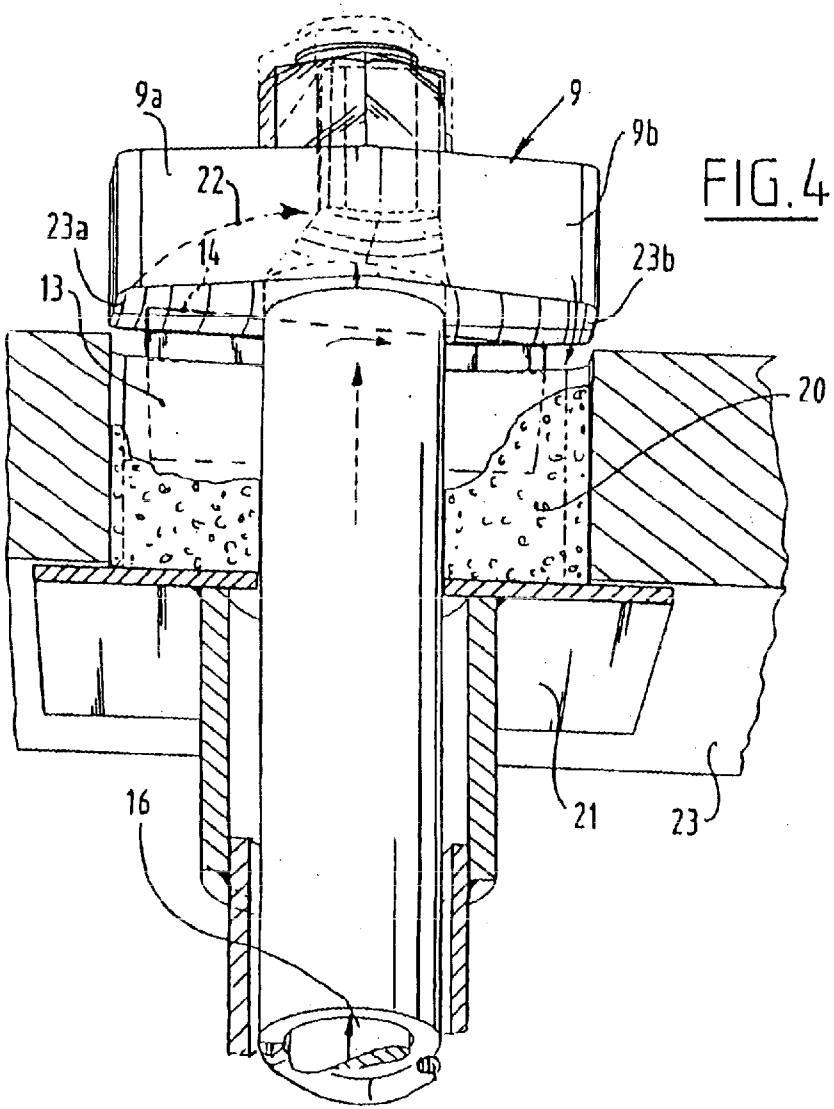
FIG. 4 is a partly broken-away perspective view on enlarged scale of the clamp according to detail IV of FIG. 3.
Figure 6:
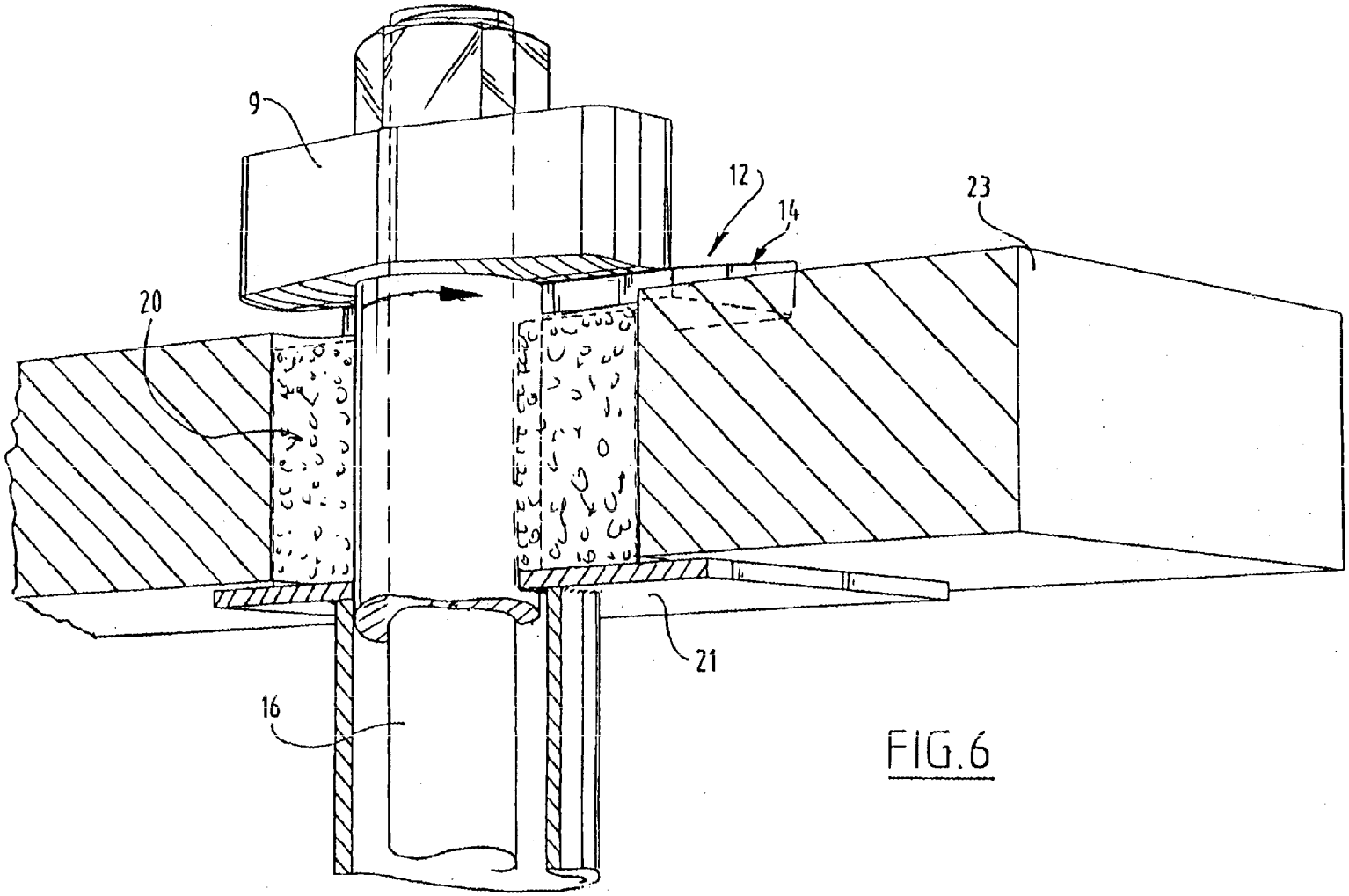
FIG. 6 shows the clamp according to FIG. 4 in an alternative embodiment on still further enlarged scale.

It is noted that the angle of inclination of contact surfaces 14 in FIGS. 4 and 5 differs from this angle in FIG. 6.

Diverse aspects of the door structure according to WO-A-98/44228 in accordance with the above discussed figures also form part of the present invention. These are for instance the use of the filler piece 20 and wholly enclosing each continuous hole 13 with material. The described material choices can also be applied within the scope of the present invention, provided the basic principle of the invention is adhered to, which enables a certain deformation of the door structure while maintaining sealing and mechanical integrity.

Figure 7:
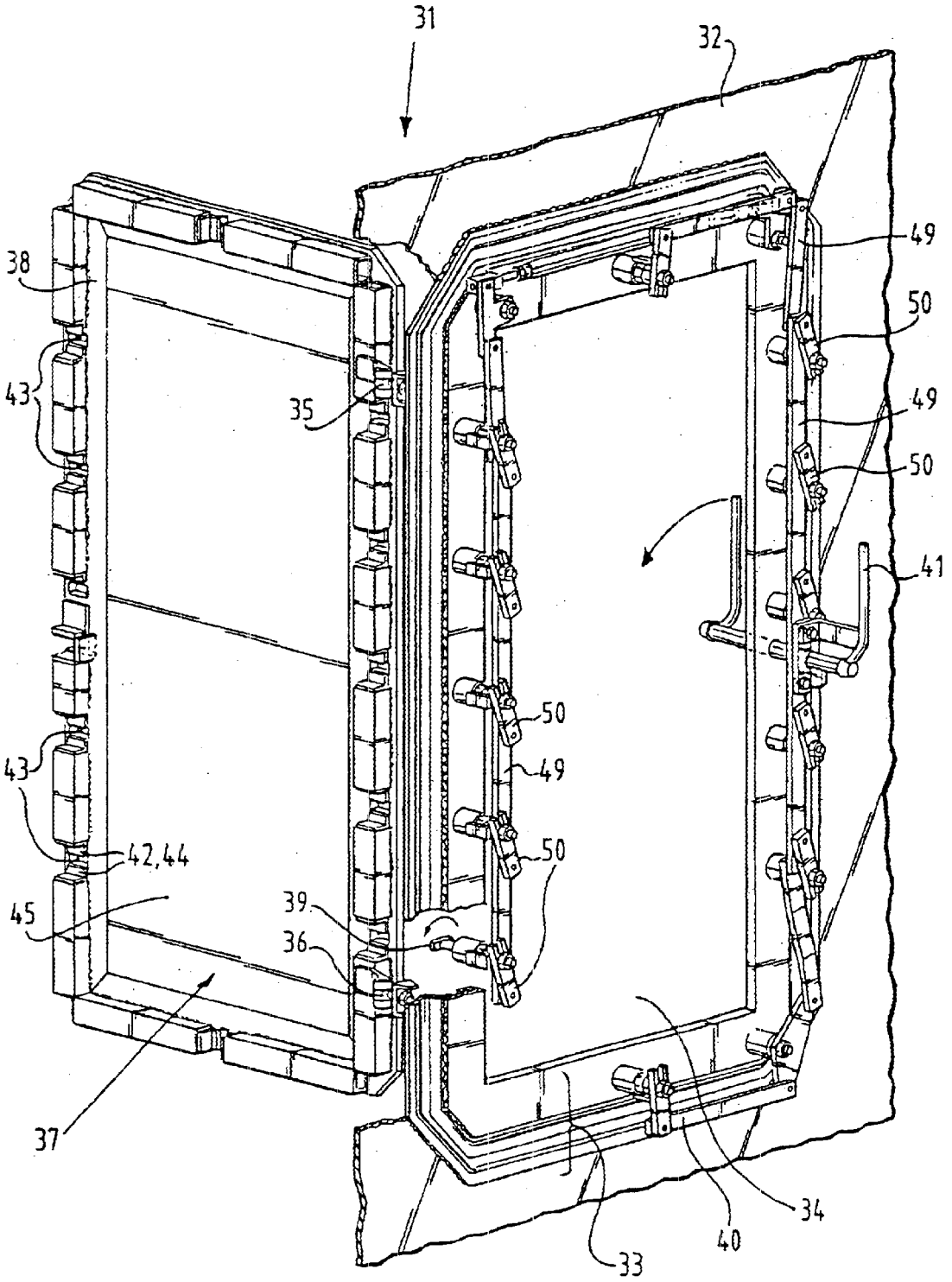
FIG. 7 shows a perspective view of a door structure according to the invention in opened position.

FIG. 7 shows a door structure 31 comprising a first plate 32 serving as fixed frame with an opening 34 enclosed by a peripheral edge 33; and a door 37 connected pivotally to this first plate 32 by two hinges 35, 36 such that with its peripheral zone 38 the door 37 can co-act sealingly with said peripheral edge 33;

which first plate 32 carries a number of peripherally arranged clamps 39, which clamps 39 are simultaneously rotatable by a collective operating mechanism 40 with an operating handle 41 and through rotation can co-act with the peripheral surfaces 42 of corresponding non-round continuous holes 43 in door 37, which peripheral surfaces 42 have for each clamp 39 a contact surface 44 inclining relative to the main plane of door structure 31 in the closed situation, which continuous holes 43 have a form such that a clamp 39 can pass therethrough.

Door 37 comprises a second plate 45 which is received in a framework 46 (see also FIGS. 8–11), which framework co-acts with the peripheral edge 33 in the closed situation of door structure 31. Clamps 39 are arranged symmetrically pairwise on rotation shafts 47 in the manner of clamps 9*a* and 9*b*. Continuous holes 43 in door 37 are correspondingly formed slotted holes. Each peripheral surface of a continuous hole 43 in door 37 has two substantially symmetrically located, inclining clamp contact surfaces corresponding with surfaces 14*a* and 14*b*.

The peripheral edge 33 is deformable under the influence of an air pressure pulse acting on the door structure in the closed position such that the whole door structure consisting of both the first plate with the peripheral edge and the door can be pressed out of the main plane it occupies when at rest while maintaining the sealing co-action between the framework and peripheral edge 33 and the mechanical integrity of door structure 31.

By means of handle 41 the rotation shaft 47 of each clamp can be rotated via transmission arms 50 between a closing position and a free position, this via a system of mutually coupled rods generally designated 49.

Figure 8:
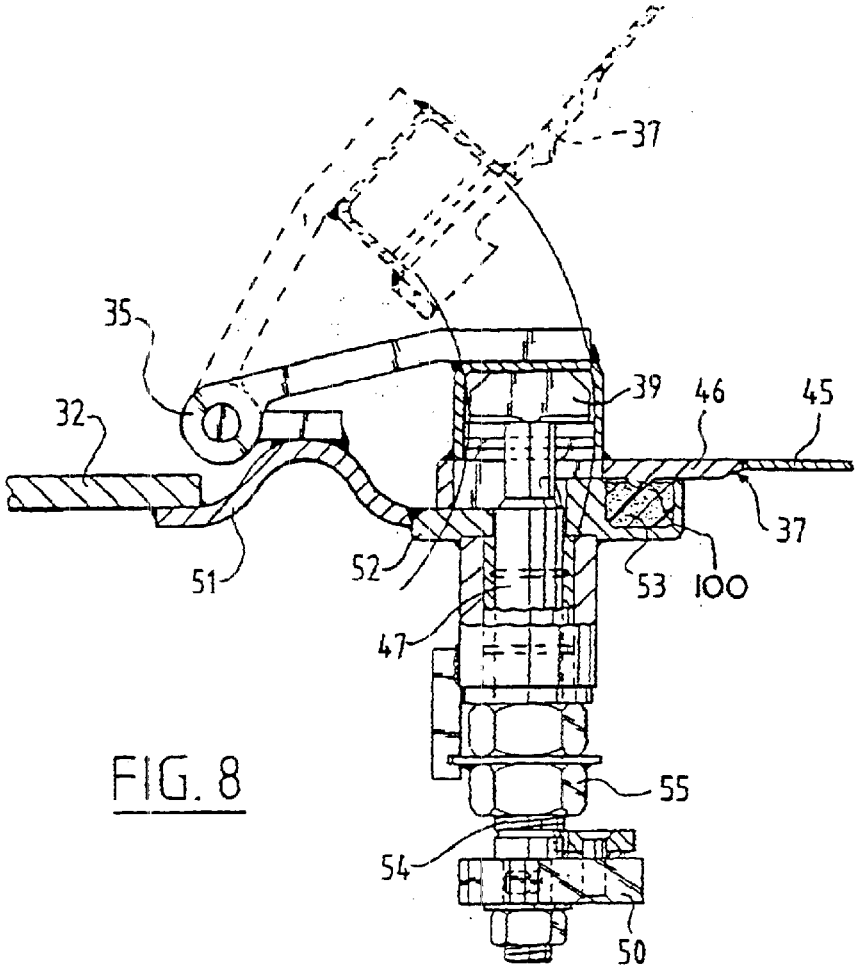
FIG. 8 shows a cross-section in the region of a clamp on the hinge side of the door structure, wherein the door is closed but not locked.
Figure 10:
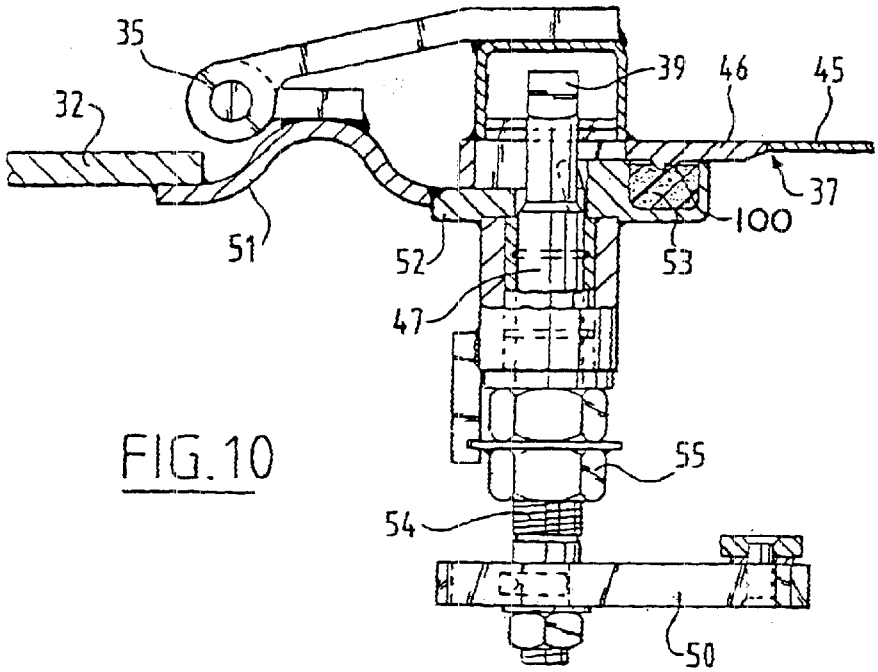
FIG. 10 shows a view corresponding with FIG. 8 of the situation in which the door is locked.

As shown particularly clearly in FIGS. 8 and 10, the peripheral edge 33 comprises a relatively thin, wave-shaped prismatic sheet-metal strip 51 to which hinges 35, 36 are welded. Strip 51 extends wholly around door opening 34 and makes a significant contribution to the deformability of the door structure. Strip 51 is welded to the first plate 32 and the remaining part 52 of peripheral edge 33.

FIG. 8 shows in full lines the situation in which door 45, 46 is placed in closed position but is not yet locked by the clamps. The wholly open position is shown with broken lines.

FIG. 10 shows the situation in which the clamps have been tightened with force. In this position the door is closed and locked by the clamps. The sealing between door 37 and first plate 32 with peripheral edge 33 is ensured by means of a neoprene rubber sealing ring 53 which co-acts with an elongate continuous elevation 100 on framework 46.

The rotation shaft 47 of each clamp 39 is provided with screw thread 54 and co-acts with a nut 55 present on peripheral edge 33 such that the rotation of a clamp entails an axial displacement. A comparison of FIGS. 8 and 10 shows the activity of this structure.

Figure 9:
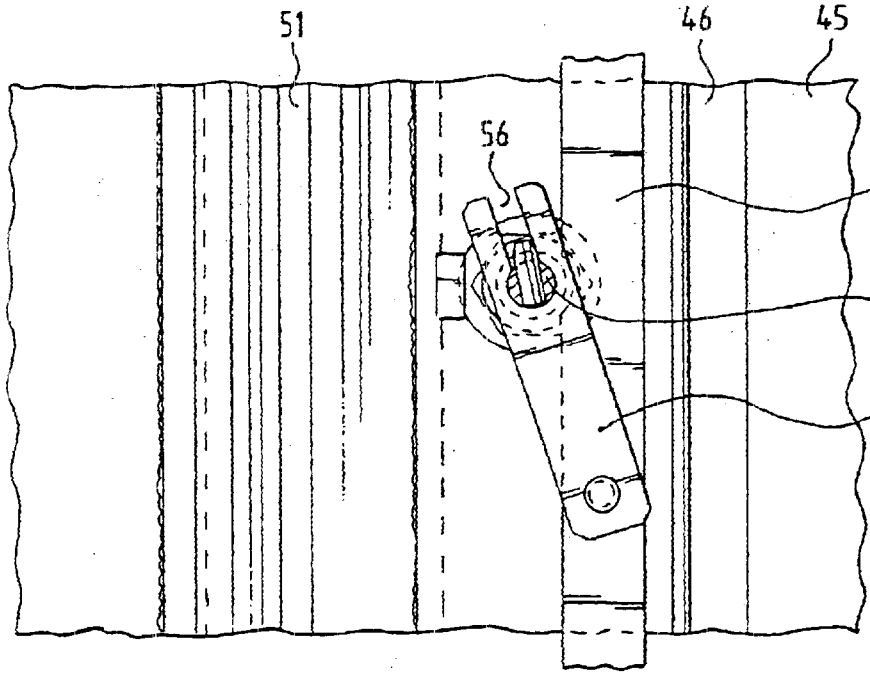
FIG. 9 is a front view of the operating mechanism in the position corresponding with FIG. 8.
Figure 11:
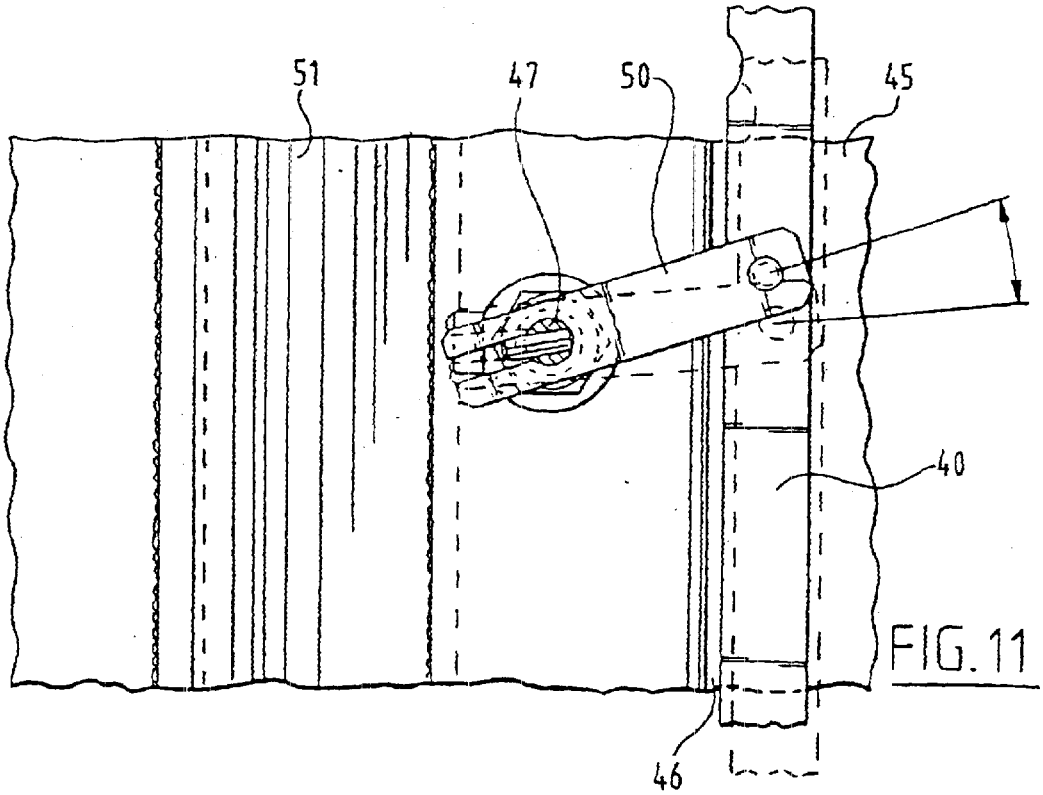
FIG. 11 shows a view corresponding with FIG. 9 of the operating means in the position corresponding with FIG. 10.

FIGS. 9 and 11 show that the rotation shaft 47 of each clamp is coupled via a transmission with a certain dead stroke to the collective operating mechanism 40. For this purpose each shaft 47 co-acts via a pin, while maintaining a certain clearance, with the side walls of a slotted hole 56 recessed on the relevant end of each operating arm 50.

Figure 12:
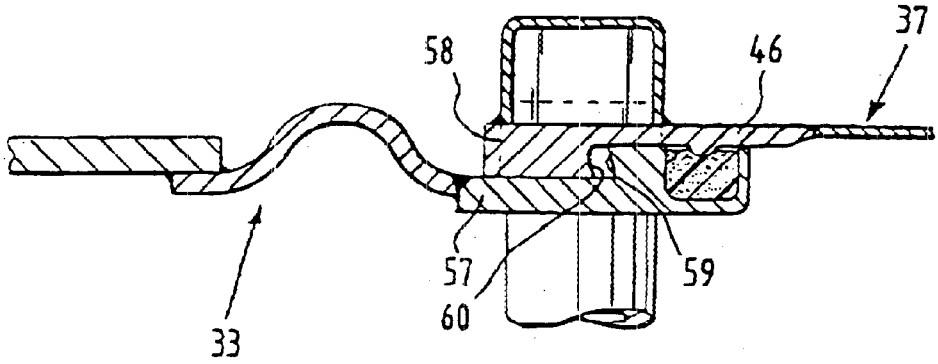
FIG. 12 shows a cross-section through a part of the structure of FIGS. 8 and 10 elucidating the hook structure.

FIG. 12 shows that on respectively peripheral edge 33 and door 37 hooking means are present which only enter into hooking co-action when a certain minimal deformation of door structure 31 is exceeded as a result of a pressure pulse acting thereon. The hooking means comprise prismatic beams 57, 58 respectively forming part of respectively the peripheral edge and framework 46. These beams have undercut surfaces 59, 60 respectively directed toward each other which, in the case of the described substantial deformation under the influence of an air pressure pulse, can enter into hooking co-action with each other. It will be apparent that in the case of such calamities the integrity of door structure 31is wholly assured.

Finally, FIG. 7 shows that peripheral edge 33 has a generally angled form. The wave-shaped prismatic strip 51 in particular has this form.

What is claimed is:

1. A door structure, comprising:

a first plate serving as a fixed frame with an opening enclosed by a peripheral edge; and a door connected pivotally to the first plate by at least one hinge construction such that the door can co-act sealingly with said peripheral edge, wherein the first plate carries a number of peripherally arranged clamps, which clamps are simultaneously rotatable by a collective operating mechanism comprising an operating handle said clamps, through rotation, can co-act with corresponding non-round continuous slotted holes in the door for locking the door structure in a closed position, and wherein each clamp includes a contact surface, wherein the contact surfaces are each inclined relative to a main plane of the door structure in the closed position, wherein each of said continuous holes has a form such that a corresponding one of said clamps can pass therethrough, wherein the door comprises a second plate which is received in a framework which co-acts sealingly with the peripheral edge when said door structure is in the closed position, wherein the clamps are arranged in pairs about said opening and each clamp includes a symmetrically rotation shaft, wherein a peripheral surface of each of said continuous holes in the door has two substantially symmetrically located, inclined clamp contact surfaces, and wherein the peripheral edge is deformable under an air pressure pulse acting on the door structure in the closed position such that at least the door can be pressed out of the main plane while maintaining the sealing co-action between the framework and the peripheral edge and while maintaining mechanical integrity of the door structure.

2. The door structure as claimed in claim 1, wherein the second plate has a thickness substantially smaller than a thickness of the first plate.

3. The door structure as claimed in claim 2, wherein the thickness of the second plate is a maximum of 0.3 times the thickness of the first plate.

4. The door structure as claimed in claim 1, wherein the peripheral edge comprises a plate part which has a general wave shape with at least one wave.

5. The door structure as claimed in claim 4, wherein the peripheral edge is angled at four corners there of to form an octagon.

6. The door structure as claimed in claim 5, wherein the angles of the octagon are between about 115° and about 155°.

7. The door structure as claimed in claim 1, wherein the door structure consists substantially of steel.

8. The door structure as claimed in claim 1, comprising a hooking mechanism on the peripheral edge and a peripheral zone of said door which only enters into hooking co-action when a certain minimal deformation of the door structure is exceeded as a result of the air pressure pulse acting thereon.

9. The door structure as claimed in claim 1, wherein the peripheral edge comprises a plate part with a thickness substantially smaller than a thickness of the first plate.

10. The door structure as claimed in claim 9, wherein the plate part consists of a steel plate and the thickness of a maximum of said plate part is 5 mm.

11. The door structure as claimed in claim 9, wherein the thickness of the plate part is a maximum of 0.5 times the thickness of the first plate.

12. The door structure as claimed in claim 1, wherein the clamps and the holes are placed symmetrically on said door structure.

13. The door structure as claimed in claim 1, wherein the door structure consists substantially of metal.

14. The door structure as claimed in claim 1, wherein the second plate consists of a steel plate with a thickness of a maximum of 3 mm.

15. The door structure as claimed in claim 1, comprising a neoprene rubber sealing ring which seals the door relative to the first plate when said door structure is in the closed position.

16. The door structure as claimed in claim 1, wherein each rotation shaft includes a screw thread which co-acts with a nut such that rotation of said rotation shaft entails an axial displacement of said rotation shaft with respect to said nut.

17. The door structure as claimed in claim 1, wherein each clamp is coupled via a transmission to the collective operating mechanism.

* * * * *

UNITED STATES PATENT AND TRADEMARK OFFICE

CERTIFICATE OF CORRECTION

PATENT NO. : 6,640,498 B1
DATED : November 4, 2003
INVENTOR(S) : Dirk Hugo Groeneveld It is certified that error appears in the above-identified patent and that said Letters Patent is hereby corrected as shown below:

Column 6,
Line 37, "31is" should read -- 31 is --.
Line 51, after "handle" insert -- , -- (comma).
Lines 65-67, should read as follows:
-- wherein the clamps are arranged in pairs symmetrically about said opening and each clamp includes a rotation shaft, --.

Column 7,
Line 21, "there of" should read -- thereof --.

Signed and Sealed this

Thirteenth Day of April, 2004

JON W. DUDAS
*Acting Director of the United States Patent and Trademark Office*